US008257132B2

(12) United States Patent
Frank

(10) Patent No.: US 8,257,132 B2
(45) Date of Patent: Sep. 4, 2012

(54) DOLL KIT

(75) Inventor: Lisa Frank, Tucson, AZ (US)

(73) Assignee: Lisa Frank, Inc., Tucson, AZ (US)

( * ) Notice: Subject to any disclaimer, the term of this patent is extended or adjusted under 35 U.S.C. 154(b) by 186 days.

(21) Appl. No.: 12/834,729

(22) Filed: Jul. 12, 2010

(65) Prior Publication Data

US 2011/0165820 A1 Jul. 7, 2011

Related U.S. Application Data

(60) Provisional application No. 61/224,810, filed on Jul. 10, 2009.

(51) Int. Cl.
*A63H 3/16* (2006.01)
*A63H 3/00* (2006.01)

(52) U.S. Cl. ..... 446/97; 446/99; 446/121

(58) Field of Classification Search ..... 446/71–73, 446/85, 97, 99, 120, 121, 321, 486
See application file for complete search history.

(56) References Cited

U.S. PATENT DOCUMENTS

| | | | | |
|---|---|---|---|---|
| 1,566,801 | A | 12/1925 | Millard | |
| 1,971,545 | A | 8/1934 | Tompkins | |
| 3,660,926 | A | 5/1972 | Lerner et al. | 46/1 |
| 4,205,482 | A | 6/1980 | Christiansen et al. | 46/22 |
| 4,322,004 | A | 3/1982 | Schwuchow | 206/575 |
| 5,022,886 | A | 6/1991 | Jenkins | 446/268 |
| 5,743,404 | A * | 4/1998 | Melashenko et al. | 206/524.3 |
| 6,146,721 | A | 11/2000 | Freynet | 428/7 |
| 6,250,985 | B1 * | 6/2001 | Nicholson | 446/76 |
| 6,280,283 | B1 | 8/2001 | Sisler | 446/100 |

OTHER PUBLICATIONS

International Search Report & Written Opinion, PCT/US2010/041743, dated Sep. 17, 2010.

Mr. Potato Head, Wikipedia, http://en.wikipedia.org/wiki/Mr_Potato_Head, Jun. 26, 2009.

* cited by examiner

*Primary Examiner* — Kien Nguyen
(74) *Attorney, Agent, or Firm* — Hayes Soloway P.C.

(57) ABSTRACT

A toy kit for creating a three-dimensional object such as an Easter egg, or a doll having a humanoid or animal appearance is described. The kit has at least two parts formed of resiliently deformable material. One of the part or parts includes posts extending outwardly from a surface thereof for mating with corresponding holes formed in the other part or parts.

8 Claims, 9 Drawing Sheets

DOLL KIT

CROSS REFERENCE TO RELATED APPLICATION

This application claims priority from U.S. Provisional Application Ser. No. 61/224,810, filed Jul. 10, 2009.

BACKGROUND OF THE INVENTION

This invention relates to toys and, more particularly, to a toy kit for constructing three dimensional objects. The invention has particular utility for creating dolls having a humanoid or animal appearance, and accessories therefor, and will be described in connection with such utility, although other utilities are contemplated.

Toys for constructing dolls and other figures have long been available in two-dimensional versions, where children cut figures from cardboard and apply paper clothes over them. Another toy in the prior art has a three-dimensional body molded out of a hard plastic with a fanciful shape. The body has holes, and the facial and body features have pegs formed thereon for placement in the holes to attach the facial and body features to the plastic body. The facial and body features are also molded out of hard plastic, so when the body is decorated with such facial and body features, the result is a hard plastic toy. Mr. Potato Head® is an example of a toy of this type that has been available in the United States and elsewhere for over 50 years. While highly successful, dolls such as Mr. Potato Head® dolls have disadvantages. For one, being formed of a hard rigid material, the dolls and accessories could cause property damage and/or injuries if, for example, they are thrown by a child. Also, children with tactile defensiveness may avoid playing with such toys.

OBJECT OF THE INVENTION

Accordingly, it is an object of the invention to provide a novel three-dimensional objects that overcomes the aforesaid and other disadvantages of the prior art.

SUMMARY OF THE INVENTION

The present invention provides a toy kit for constructing or modifying three dimensional objects such as dolls having a humanoid or animal appearance formed entirely of resiliently deformable materials. In a preferred embodiment, the kit includes at least one body or base part, and one or more accessory parts which accessory parts may include a body feature which completes the body, such as a head, arms, legs, hairstyle, etc., and optionally includes one or more accessory parts such as clothing, food, or tools. However, the invention is not limited to constructing or modifying humanoid or animal structures, but may also be used for constructing or modifying other three-dimensional structures such as Easter eggs or other art forms. Each kit includes body or base parts, and/or accessory parts, preferably two or more body or base parts and at least one accessory part. The body or base parts and/or accessory parts include posts extending outwardly from a surface thereof for mating with corresponding holes formed in the other.

BRIEF DESCRIPTION OF THE DRAWINGS

Further features and advantages of the invention will be seen from the following detailed description, taken into conjunction with the accompanying drawings, wherein.

DETAILED DESCRIPTION OF PREFERRED EMBODIMENTS

Figure 1:
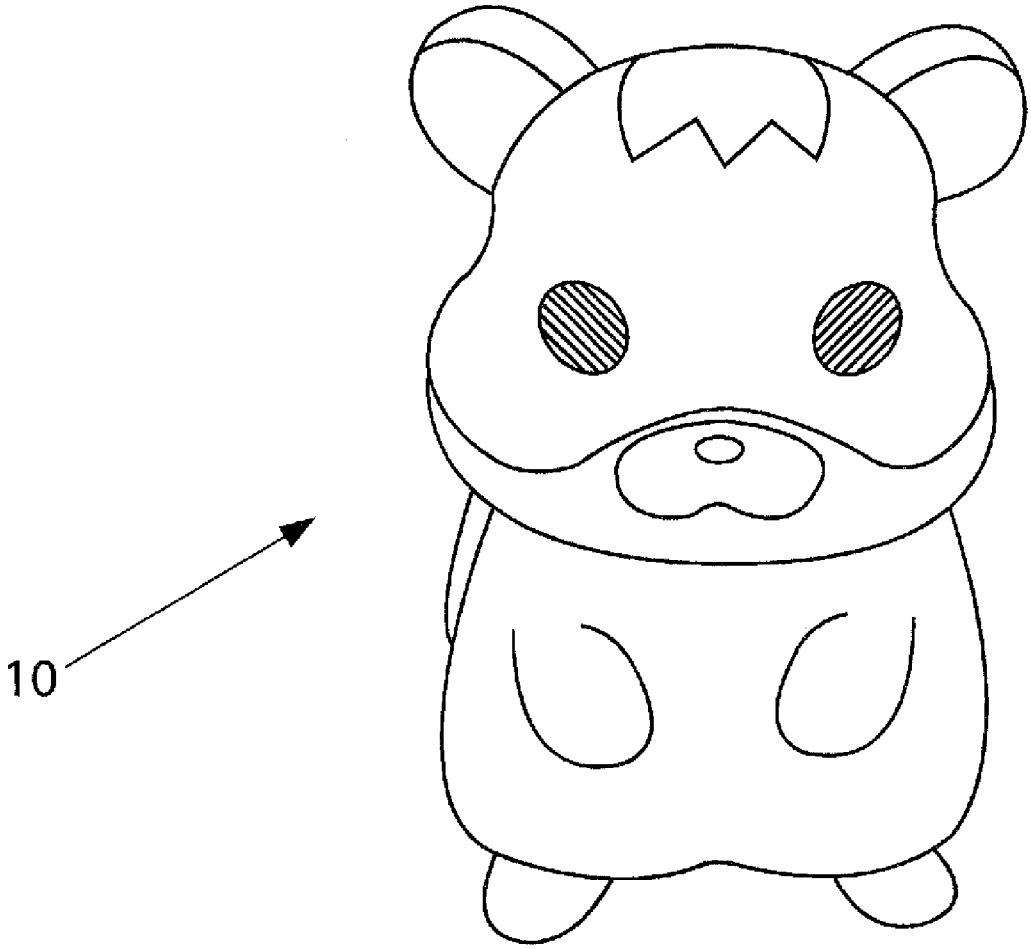
FIG. 1 and FIG. 2 show front and side perspective views of a two-part doll in accordance with one embodiment of the present invention.
Figure 2:
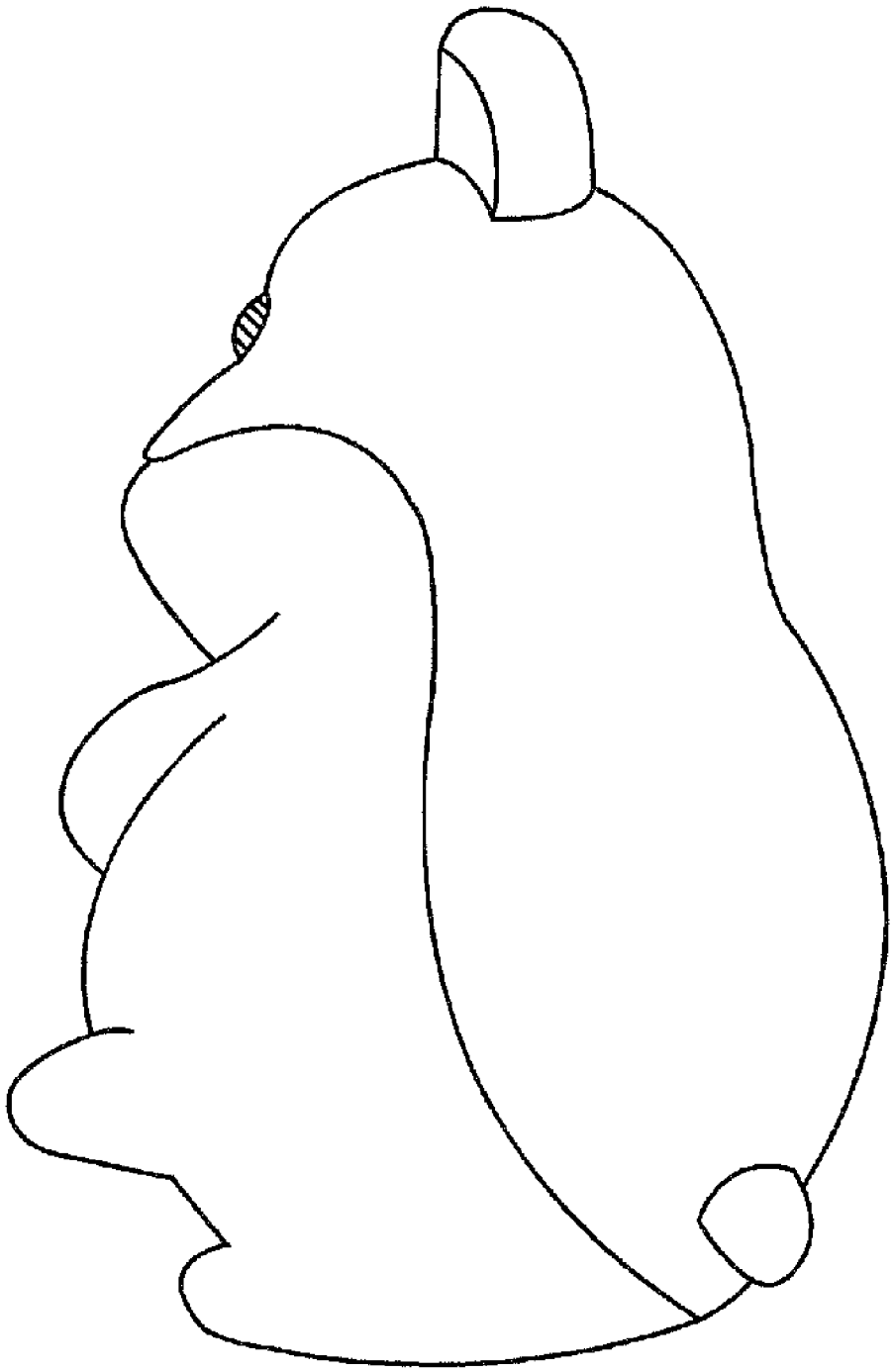
Figure 3:
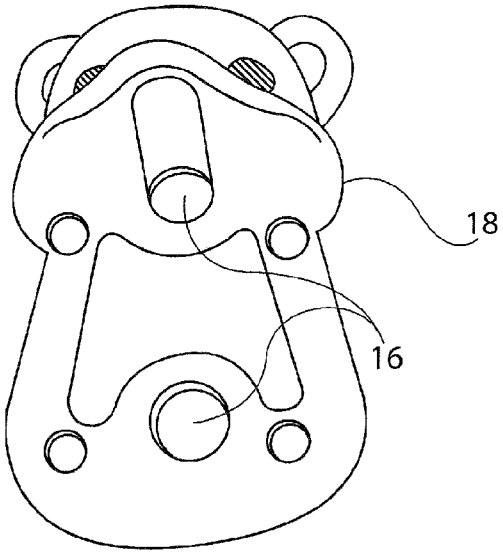
FIGS. 3 and 4 show the two individual parts that make up the doll of FIGS. 1 and 2.
Figure 4:
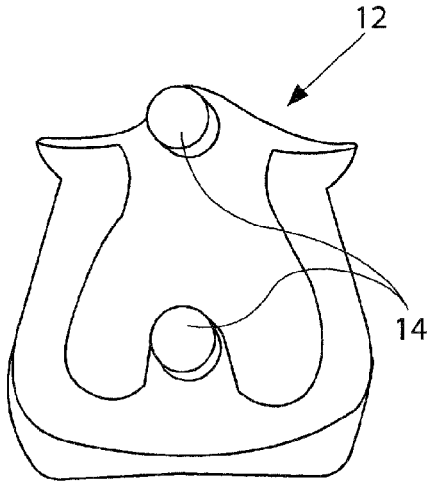
Figure 5:
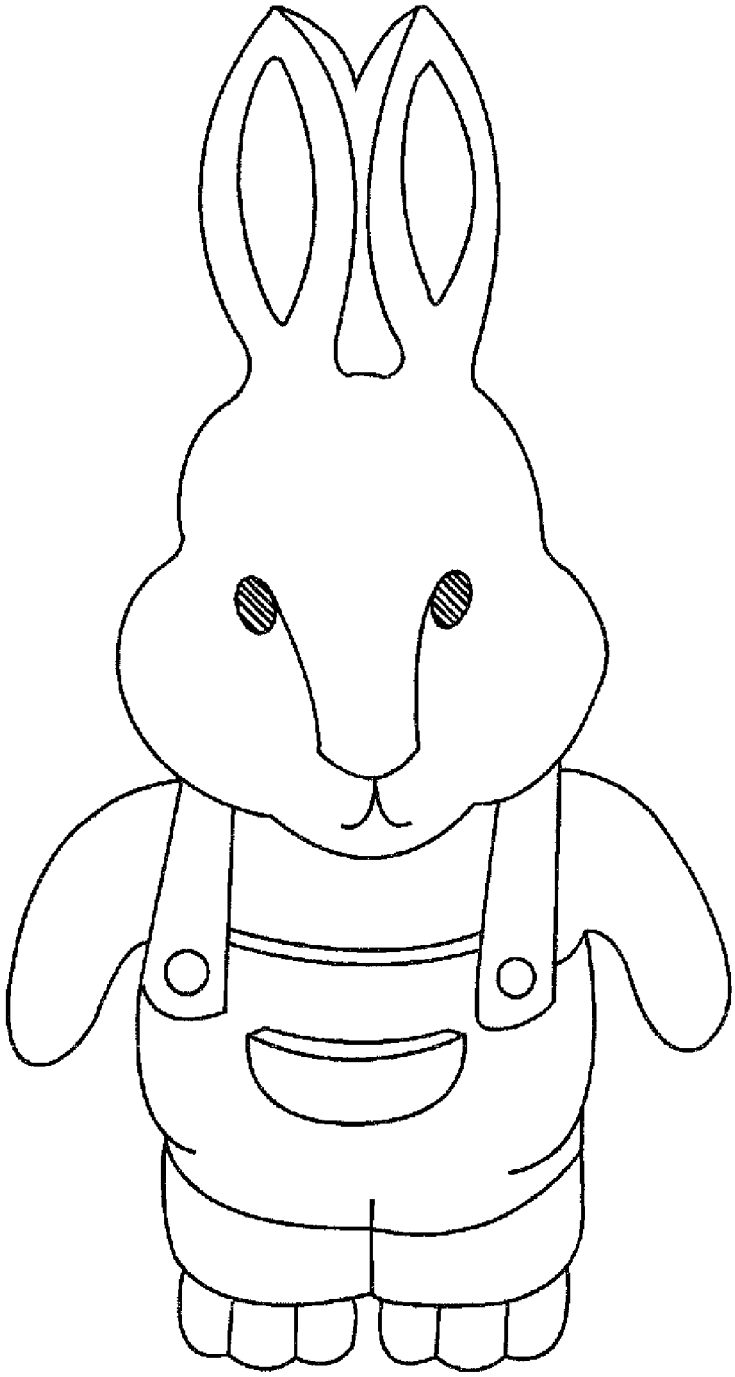
FIG. 5 is a perspective view of an alternative doll in accordance with the present invention.
Figure 6:
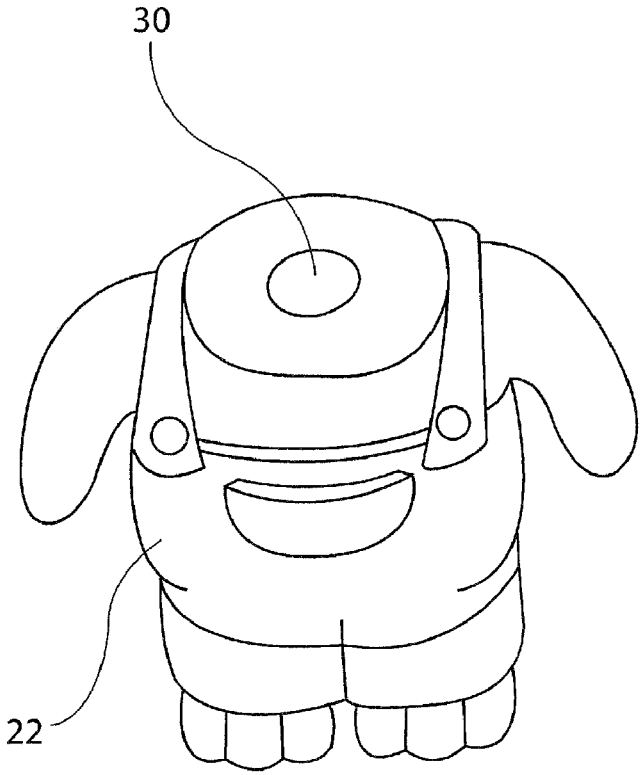
FIGS. 6 and 7 are front and rear perspective views of the body parts of the FIG. 5 doll.
Figure 7:
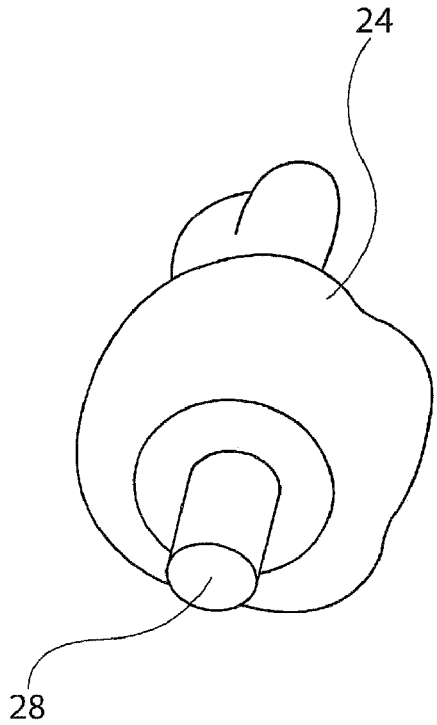
Figure 8:
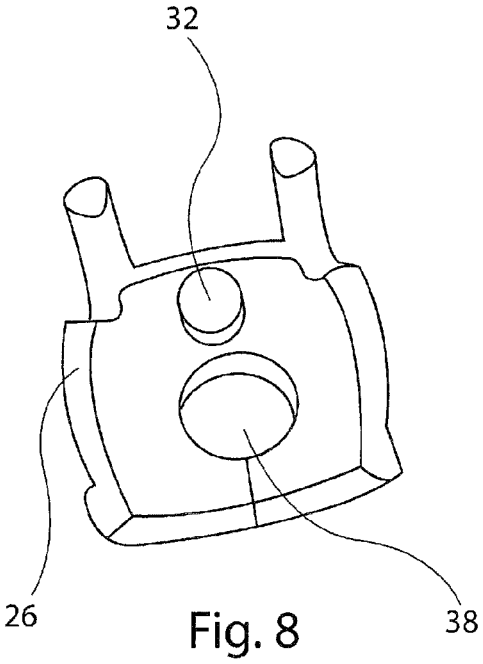
FIGS. 8 and 9 are perspective views of accessory parts that form the remainder of the body of the FIG. 5 doll.
Figure 9:
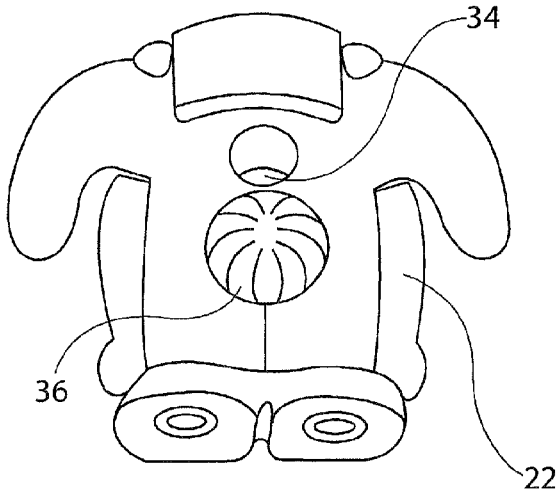

Referring to the drawings, FIGS. 1 and 2 illustrate a fully assembled doll in accordance with the present invention, and FIGS. 3 and 4 illustrate the two parts that make up the doll. All of the parts that make up the doll are formed of resiliently deformable materials, which in a preferred embodiment comprises natural or synthetic rubber of the type used for forming rubber erasers. Rubber eraser material is preferred since it has a feel familiar to children, is rigid enough to maintain shape, but is soft enough to not damage property or cause injury in the event the part is thrown. Referring in particular to FIGS. 3 and 4, one of the parts 12 has a pair of posts 14 for engaging in holes 16 in the other part 18. In order to facilitate assembly of the parts together, posts 14 and/or hole 16 preferably are slightly tapered. Posts 14 and 16 are sized and shaped relative to one another so as to permit a low friction fit so that the parts stay together once fitted to one another. However, the parts should not fit so tightly that they cannot be taken apart. In a preferred embodiment, the parts are sold as a kit, comprising two or more sets of parts in different colors or patterns, sizes and shapes so that a doll or dolls may be arranged in different combinations, e.g. similar to doll kits such as Mr. Potato Head® dolls. If desired, the parts and holes may have different size/shapes so that the child learns to match sizes and shapes, thus learning special relationships. Providing different size/shape posts and holes for different parts also can be used to teach a child the proper location of, e.g. eyes, ears, noses, mouths, etc. This also permits an adult to play a learning game with a child, e.g. to locate and position a particular body part, e.g. eye, ear, nose, etc., on a head in response to a spoken word.

FIGS. 5-9 illustrate an alternative doll 20 made in accordance with the present invention. Doll 20 comprises three pieces, a front base 22, a head 24 and back base 26. As before, the pieces are fitted together with pegs and holes 28, 30, 32, 34. However, in this embodiment, an additional peg 36 on the front base 22 also provides a decorative function when assembled through hole 38 on the back base 26, i.e. of forming a bunny tail.

As before, a plurality of parts could be sold as a kit with, for example, clothing in several different colors, or bearing different patterns; the main body having different arm positions, the head different ear, nose, mouth and hair shapes and sizes, etc.

Figure 10:
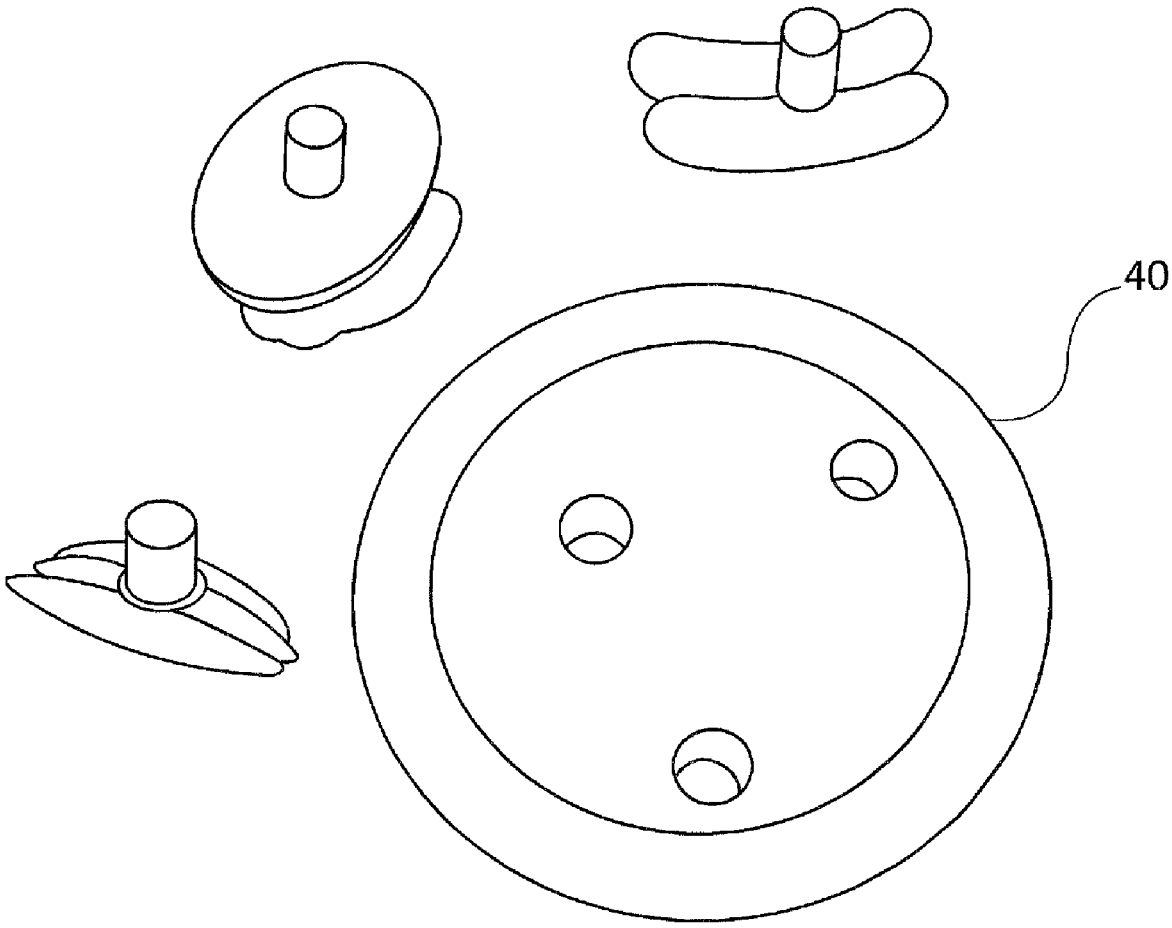
FIG. 10 shows a four-piece accessory kit in accordance with the present invention.
Figure 11:
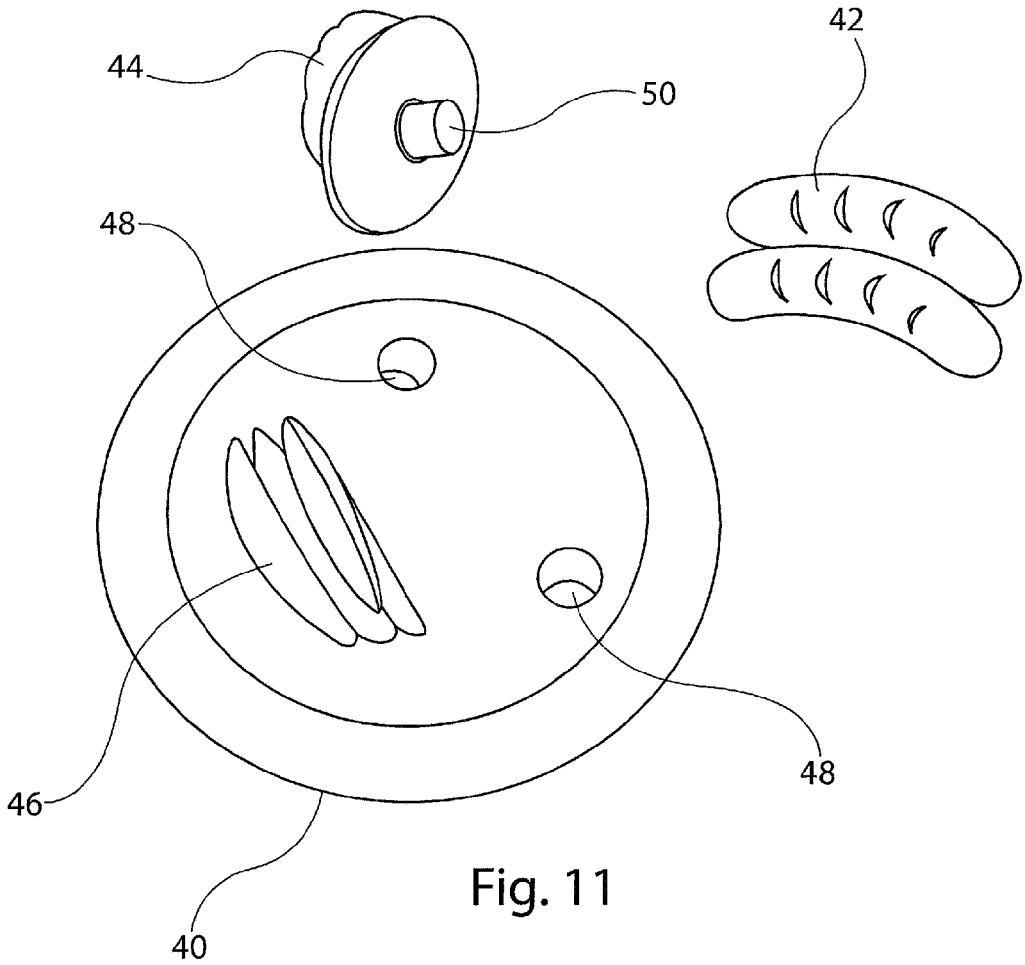
FIG. 11 shows the accessory kit of FIG. 10 partially assembled.

Referring to FIGS. 10 and 11, there is illustrated an accessory toy made according to the present invention. Here the accessory toy comprises a base in the shape of a dish 40 and a plurality of molded food parts 42, 44, 46. The dish 40, and food parts 42, 44 and 46 are all formed of a resiliently deformable material such as rubber eraser material. As before, the base dish part has a plurality of holes 48 sized to accept posts 50 integrally formed as part of the food parts. Again, a plurality of plates and food items may be provided as a kit.

Figure 12:
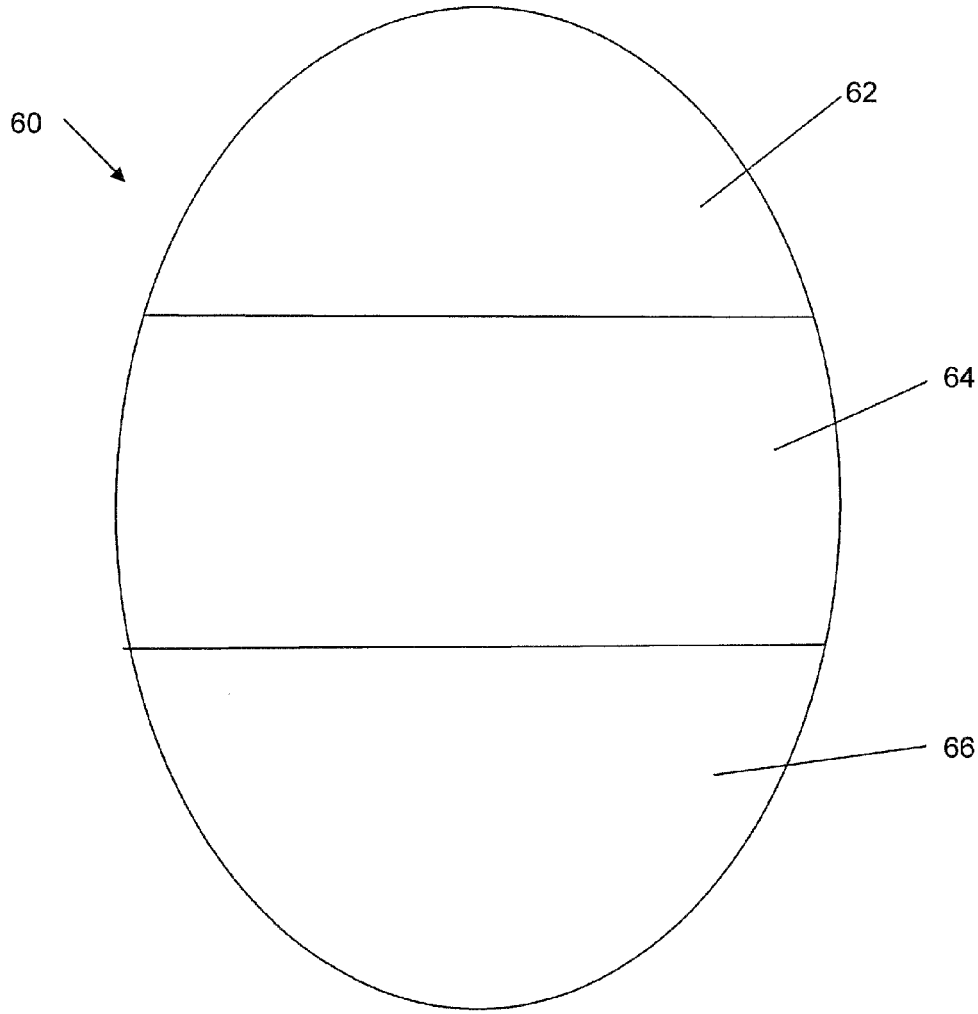
FIG. 12 shows an Easter egg kit in accordance with the present invention.

FIG. 12 illustrates an Easter egg 60 from several parts 62, 64, 66 which may be combined in different combinations to create different designs in accordance with the present invention. The pegs 68 and holes 70 are shown in phantom As can be seen from the foregoing description, the present invention provides a unique toy kit that permits a child to create various designs, shapes or configurations by providing a plurality of parts which connect with or attach to each other. However, unlike prior art doll kits such as Mr. Potato Head® dolls, the parts are formed of a resiliently deformable material that provides a particularly pleasing and familiar hand feel.

The toy kits have significant level of play value whether used alone or in combination with other accessories of the present invention. Moreover, the various parts may be sold as kits of parts or as individual parts which may be assembled in various ways, or collected and/or traded.

The simple construction of the toy kit parts of the present invention make them readily adapted for a variety of shapes and sizes. Moreover, forming the parts of resiliently deformable material, makes them less likely to cause injury or damage if thrown by a child. Accordingly, it is seen that the toy kit of the instant invention represents significant advancements in the toy art.

While there has been shown and described herein certain specific structures embodying the invention, various modifications and re-arrangements of the parts may be made without departing from the spirit and scope of the underlying inventive concept, and the same is not limited to particular forms herein shown and described except insofar as indicated by the scope of the appended claims.

The invention claimed is:

1. A toy kit for creating a three-dimensional object comprising at least two parts formed of resiliently deformable material, wherein one of the part or parts includes posts extending outwardly from a surface thereof for mating with corresponding holes formed in the other part or parts, wherein one of the parts has the shape of a humanoid or animal partial body, in part, and the other part or parts complete the humanoid or animal body, and wherein the posts and holes have different sizes and shapes for teaching a child proper location of a body part.

2. The toy kit of claim 1, wherein the parts are formed of rubber.

3. The toy kit of claim 1, wherein the posts and/or holes are tapered, at least in part.

4. The toy kit as claimed in claim 1, wherein the body part is selected from the group consisting of an eye, an ear, a nose, a mouth and hair.

5. A toy kit comprising a base part and one or more accessory parts all formed of a resiliently deformable material, wherein the accessory parts include posts for engaging in holes in the base part, wherein one of the parts has the shape of a humanoid or animal partial body, in part, and the other part or parts complete the humanoid or animal body, and wherein the posts and holes have different sizes and shapes for teaching a child proper location of a body part.

6. The toy kit as claimed in claim 5, wherein the posts and/or holes are tapered at least in part.

7. The toy kit as claimed in claim 5, wherein the parts are formed of rubber.

8. The toy kit as claimed in claim 5, wherein the body part is selected from the group consisting of an eye, an ear, a nose, a mouth and hair.

* * * * *